US005214398A

United States Patent [19]

Hayashi

[11] Patent Number: 5,214,398

[45] Date of Patent: May 25, 1993

[54] DIELECTRIC FILTER COUPLING STRUCTURE HAVING A COMPACT TERMINAL ARRANGEMENT

[75] Inventor: Shotaro Hayashi, Yamaguchi, Japan

[73] Assignee: Ube Industries, Ltd., Yamaguchi, Japan

[21] Appl. No.: 783,171

[22] Filed: Oct. 28, 1991

[30] Foreign Application Priority Data

Oct. 31, 1990 [JP] Japan ..... 2-292118
Oct. 8, 1991 [JP] Japan ..... 3-287185

[51] Int. Cl.[5] ..... H01P 1/205
[52] U.S. Cl. ..... 333/206; 333/207
[58] Field of Search ..... 333/202, 206, 207, 222, 333/223

[56] References Cited

U.S. PATENT DOCUMENTS

| | | | |
|---|---|---|---|
| 4,276,525 | 6/1981 | Nishikawa et al. | 333/206 |
| 4,703,291 | 10/1987 | Nishikawa et al. | 333/202 |
| 4,745,379 | 5/1988 | West et al. | 333/206 |
| 4,800,347 | 1/1989 | Yorita et al. | 333/202 |
| 4,983,938 | 1/1991 | Sasaki et al. | 333/207 |
| 4,987,393 | 1/1991 | Yorita et al. | 333/202 |

FOREIGN PATENT DOCUMENTS

| | | | |
|---|---|---|---|
| 0336255 | 3/1989 | European Pat. Off. . | |
| 55-35560 | 3/1980 | Japan . | |
| 56-57302 | 5/1981 | Japan . | |
| 0215102 | 12/1983 | Japan | 333/202 |
| 0125001 | 5/1989 | Japan | 333/202 |
| 0055402 | 2/1990 | Japan | 333/202 |

*Primary Examiner*—Robert J. Pascal
*Assistant Examiner*—Seung Ham
*Attorney, Agent, or Firm*—Sughrue, Mion, Zinn, Macpeak & Seas

[57] ABSTRACT

A plurality of coaxial type dielectric resonators 1A, 1B each having a dielectric 5 filled between an inner conductor 4 and an outer conductor 3 a dielectric block 2 for capacitor coupling between resonators and between the resonators and input/output terminals. The dielectric block has holes 6A, 6B opposed to the inner conductors 4 of the dielectric resonators, with electrodes 7A and 7B being formed on the inner surfaces of the holes. The electrodes 7A and 7B of the coupling dielectric block and the inner conductors 4 of the resonators associated therewith are connected through electroconductive spacers 9. Further, an input terminal electrode 8A and an output terminal electrode 8B are each formed on at least one of outer peripheral faces of the coupling dielectric block 2. The terminal electrodes 8A and 8B are both formed on one side, outer peripheral face of the dielectric block, or are formed on both end, outer peripheral faces respectively of the dielectric block. This construction permits a sufficient reduction in size of a dielectric filter while retaining desired characteristics.

12 Claims, 8 Drawing Sheets

DIELECTRIC FILTER COUPLING STRUCTURE HAVING A COMPACT TERMINAL ARRANGEMENT

FIELD OF THE INVENTION

The present invention relates to a dielectric filter coupling structure comprising a plurality of coaxial type dielectric resonators in combination. Particularly, the invention is concerned with a dielectric filter coupling structure wherein the coupling between dielectric resonators is performed by means of the capacitor.

BACKGROUND OF THE INVENTION

According to conventional structures for electrical coupling between resonators and also between resonators and input/output terminals in dielectric filters of this type, as is described, for example, in Japanese Patent Laid-Open Nos. Sho 56-57302 and 55-35560, which correspond to U.S. Pat. Nos. 4,342,972 and 4,268,809 respectively, a dielectric is filled between inner and outer conductors to constitute a coaxial type dielectric resonator and a plurality of such resonators are arranged, or plural such resonators are arranged integrally using an outer conductor as a common conductor to constitute a dielectric filter, and there is used a dielectric block for capacitor coupling between resonators and between resonators and input/output terminals in such dielectric filter. The dielectric block for coupling is in the shape of a flat plate and is disposed in facing relation to the plural resonators of the dielectric filter. On the surface of the dielectric block there are formed electrode patterns which are each electrically coupled correspondingly to the inner conductor of each dielectric resonator. Further, the capacitance between adjacent resonators is adjusted to a preset value by selecting a suitable material of the dielectric block for coupling and by setting the capacitance of each coupling capacitor between the electrode patterns at a suitable value.

However, in the course of promotion of the reduction in size of such dielectric resonators the following problem arose. In the case of using a plurality of coaxial type dielectric resonators for constituting a dielectric filter, the distance between adjacent inner conductors becomes shorter with the reduction in size of the resonators, so it is unavoidable that the electrode patterns formed on the surface of the dielectric block for coupling also becomes smaller in size. Thus, with the reduction in size of the resonators, there arises the problem that the area of each electrode pattern becomes so small that a desired capacitance of each coupling capacitor is not obtained. In other words, in order to form electrode patterns planar on the surface of a flat plate-like dielectric block for coupling and obtain a desired capacitance of a coupling capacitor, it is necessary to ensure at least a minimum distance between the inner conductors of dielectric resonators, and this has been an obstacle to the reduction in size of a dielectric filter.

SUMMARY OF THE INVENTION

The present invention has been accomplished in view of the above-mentioned circumstances and it is an object of the invention to provide a dielectric filter coupling structure capable of obtaining a sufficient capacitance of each coupling capacitor by forming three-dimensional electrode patterns on the surface of the aforementioned dielectric block for coupling even when the dielectric block is reduced in size and also capable of reducing the size of a dielectric filter to a great extent while retaining desired characteristics to cope with the reduction in size of each dielectric resonator.

According to the present invention, for achieving the above-mentioned object, in a dielectric filter coupling structure wherein the dielectric filter is constituted by arranging a plurality of coaxial type dielectric resonators each having a dielectric filled between inner and outer conductors or by arranging the plural resonators integrally using an outer conductor as a common conductor and which is provided with a dielectric block for capacitor coupling between resonators of the dielectric filter and between the resonators and input/output terminals, there is provided an improvement characterized in that the dielectric block for coupling has holes in opposed relation to inner conductors of the dielectic resonators, with electrodes being formed on the inner surface of each of the holes; a spacer is interposed between the dielectric block for coupling and each of the resonators; and an input terminal electrode and an output terminal electrode are each formed on at least one of outer peripheral faces of the dielectric block.

In one aspect of the present invention, the outer peripheral face on which a part or the whole of the input terminal electrode is formed and the outer peripheral face on which a part or the whole of the output terminal electrode is formed are substantially flush with each other.

This aspect of the present invention includes an embodiment wherein an earth electrode for determining the capacitance of a coupling capacitor between the resonators is formed on an outer peripheral face of the dielectric block for coupling, the face being substantially flush with both the outer peripheral face on which a part or the whole of the input terminal electrode is formed and the outer peripheral face on which a part or the whole of the output terminal electrode is formed.

In another aspect of the present invention, both the input terminal electrode and the output terminal electrode are formed on both end, outer peripheral faces respectively in the arranged direction of the holes.

The present invention includes an embodiment, wherein the electrodes of the dielectric block for coupling and the inner conductors of the resonators are each electrically connected together. In this embodiment, an electrical connection between the electrode and the inner conductor may be performed by the spacer made of electroconductive material.

The present invention also includes an embodiment wherein an earth electrode for determining the capacitance of a coupling capacitor between the resonators is formed on a side, outer peripheral face of the dielectric block for coupling.

Further, in the present invention, there is an embodiment wherein the holes of the dielectric block for coupling are each formed in predetermined shape, size and relative position for determining the capacitance of a coupling capacitor between each electrode formed on the inner surface of the hole and the electrode of the hole adjacent thereto or the input or output terminal electrode adjacent thereto, and there also is an embodiment wherein a slit for determining the coupling capacitance between the electrodes in the holes is formed in a side, outer peripheral face of the dielectric block for coupling.

According to the dielectric filter coupling structure of the present invention, since holes are formed in a dielectric block for coupling, electrodes are formed on the inner surfaces of the holes, and each of the electrodes and an inner conductor of a resonator associated therewith are connected together through an electroconductive spacer, it is possible to obtain sufficient coupling capacitances in interresonator coupling and in resonator-input/output coupling without forming complicated planar electrode patterns even if the dielectric block is reduced in size. Consequently, in response to the reduction in size of each dielectric resonator, it is possible to fully reduce the size of the dielectric filter while retaining desired characteristics.

According to the present invention, moreover, since the input and output terminal electrodes are each formed on at least one of outer peripheral faces of the coupling dielectric block, and the outer peripheral face on which a part or the whole of the input terminal electrode is formed and the outer peripheral face on which a part or the whole of the output terminal electrode is formed are flush with each other, an electrical connection can be accomplished extremely easily by mere positioning and connection with respect to a wiring pattern formed on a circuit board.

DETAILED DESCRIPTION OF THE PREFERRED EMBODIMENTS

Embodiments of the present invention will be described in detail hereinunder with reference to the accompanying drawings.

Figure 1:
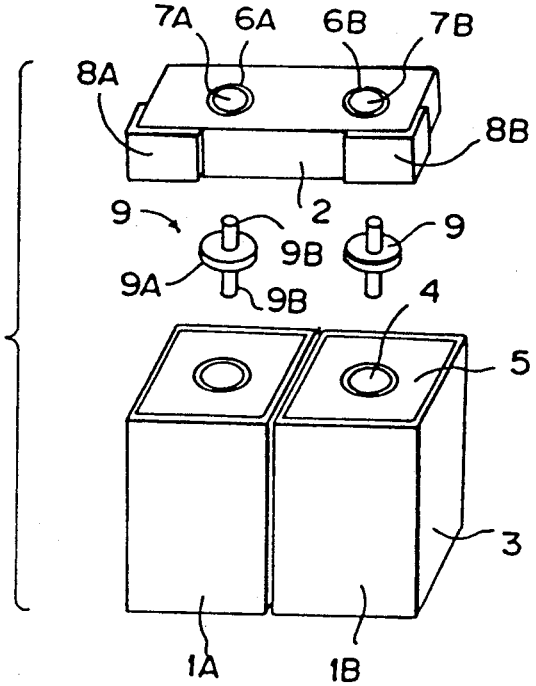
FIG. 1 is a perspective view showing an embodiment of the present invention.
Figure 2:
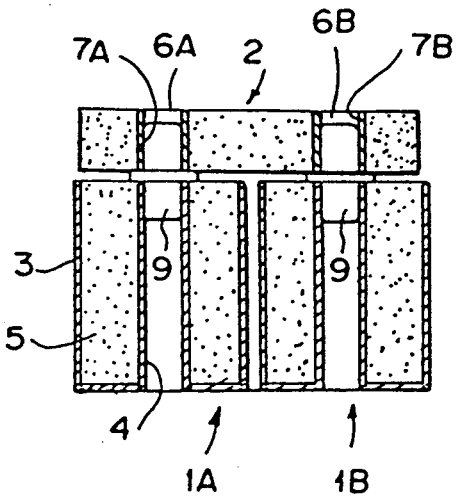
FIG. 2 is a longitudinal sectional view of FIG. 1.

In FIGS. 1 and 2, there is illustrated a dielectric filter coupling structure as a first embodiment of the present invention, comprising two coaxial type dielectric resonators 1A, 1B and a dielectric block 2 for coupling the resonators 1A and 1B. The coaxial type dielectric resonators 1A and 1B each comprises a prismatic outer conductor 3, a cylindrical inner conductor 4 and a dielectric material 5 filled between the outer and inner conductors. This construction itself is known. The dielectric block 2 is in the form of a plate having a predetermined thickness, and it has holes 6A and 6B in corresponding relation to the two inner conductors 4 of the dielectric resonators 1A and 1B. Filmy electrodes 7A and 7B are formed on the inner surfaces of those holes. Further, a filmy input terminal electrode 8A and a filmy output terminal electrode 8B are formed on one outer peripheral face of the coupling dielectric block 2. This face is substantially flush with front side faces in FIG. 1) of the resonators 1A and 1B. As shown in FIG. 1, the input and output terminal electrodes 8A and 8B may each extend up to an end, outer peripheral face (the left- or right-hand end face in FIG. 1) of the dielectric block 2 (this also applies to other embodiments which are described below).

In this embodiment, an electrical connection between the inner conductor 4 and the electrode 7A (7B) is performed using a metallic electroconductive spacer 9. The spacer 9 has an electroconductive flange 9A of a predetermined thickness in an intermediate position, and shaft portions 9B projecting up and down from the flange 9A are inserted into the hole 6A (6B) and the inner conductor 4, then bonded thereto by soldering. In this way there is effected a structural and electrical connection between the resonators 1A, 1B and the coupling dielectric block 2.

Figure 3:
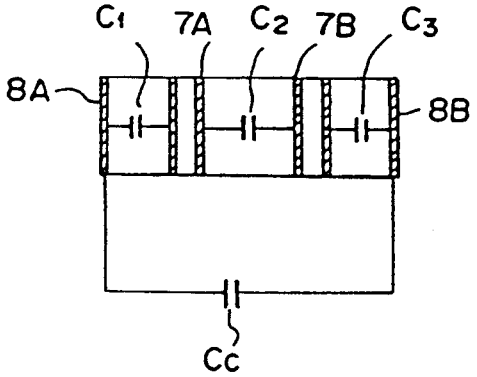
FIG. 3 is an equivalent circuit diagram of the embodiment of FIG. 1.
Figure 4:
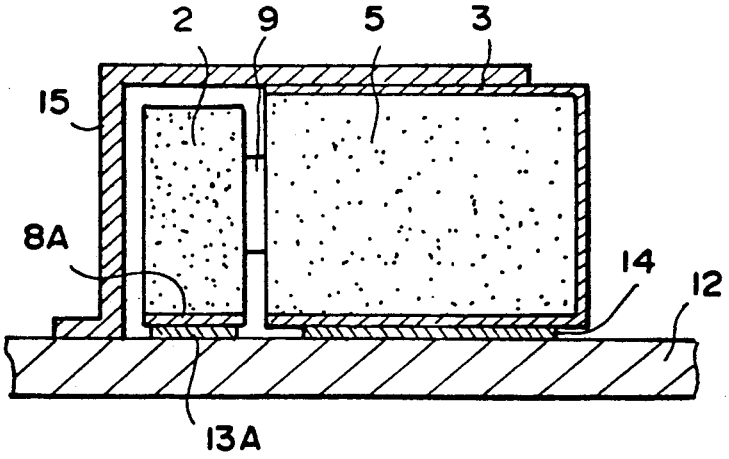
FIG. 4 is a sectional view in a mounted state of the embodiment of FIG. 1.
Figure 5:
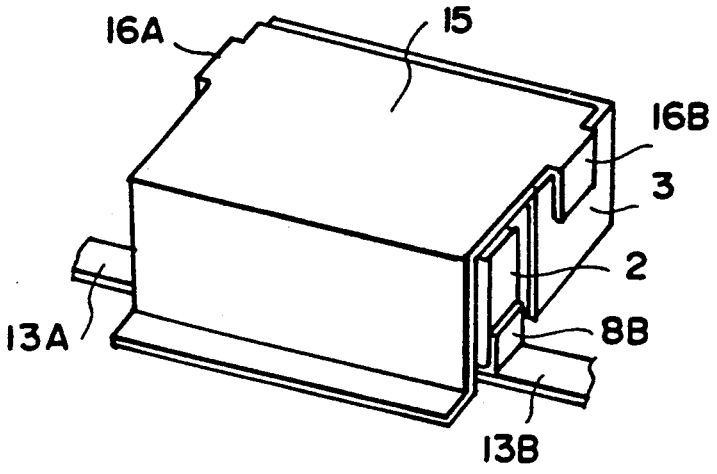
FIG. 5 is a perspective view in a mounted state of the embodiment of FIG. 1.

The dielectric filter thus coupled has an electrical construction as illustrated as an equivalent circuit in FIG. 3. As the material of the dielectric block 2 there is used a material having a specific inductive capacity of A3, for example. Equivalently, a coupling capacitance $C_2$ is interposed between the electrodes 7A and 7B, and coupling capacitances $C_1$ and $C_3$ are interposed between the input, output terminal electrodes 8A, 8B and the electrodes 7A, 7B, respectively. Further, a capacitance $C_c$ is interposed between the input, output terminal electrodes 8A and 8B. Consequently, it is possible to provide an attenuation at a low frequency side in filter characteristics of the dielectric filter, whereby the frequency characteristic in capacitor coupling can be improved The dielectric filter having the above construction can be mounted in such a manner as illustrated in FIGS. 4 and 5. In these figures, the reference numeral 12 denotes a circuit board, with a wiring pattern being formed on the surface of the board 12; the numeral 13A denotes an input line; the numeral 13B denotes an output line; and the numeral 14 denotes an earth line. The side face of the coupling dielectric block 2 on which both input and output terminal electrodes 8A, 8B are formed and the side faces of the resonators corresponding thereto are suitably positioned with respect to the wiring pattern on the circuit board 12 and bonded to the board. More specifically, the input and output lines 13A and 13B are bonded to the input and output terminal electrodes 8A and 8B, respectively, by soldering, while the earth line 14 is bonded to the outer conductors 3 of the resonators 1A and 1B also by soldering. The reference numeral 15 denotes a metallic cover having downward extended portions 16A and 16B. The cover is attached to the filter by pinching the resonators with the extended portions.

Thus, in this embodiment, an electrical connection can be done extremely easily by mere positioning with respect to the wiring pattern formed on the circuit board 12 and subsequent bonding, not requiring any special connecting line for electrical connection.

Figure 6:
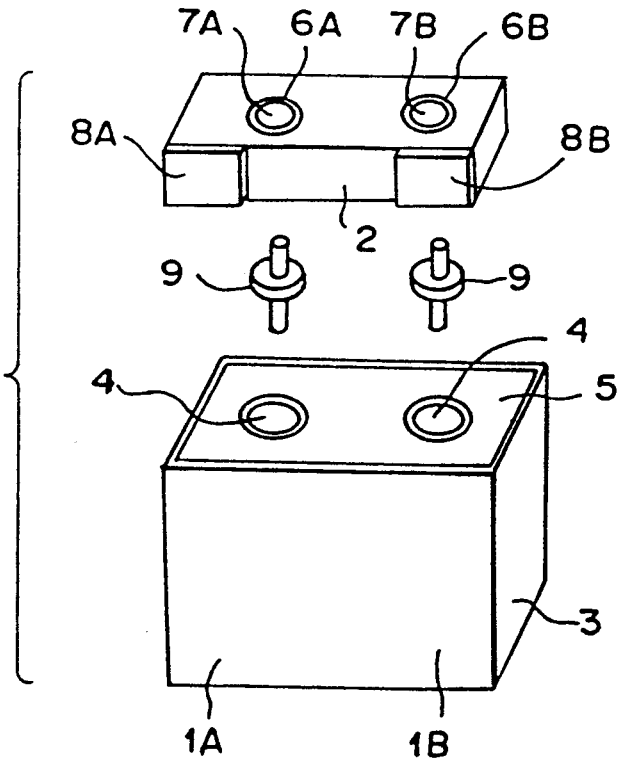
FIG. 6 is a perspective view showing another embodiment of the present invention.

In the second embodiment illustrated in FIG. 6, an outer conductor 3 is used in common to two dielectric resonators 1A and 1B, which are thus rendered integral with each other. Other constructional points are the same as in the first embodiment.

Figure 7:
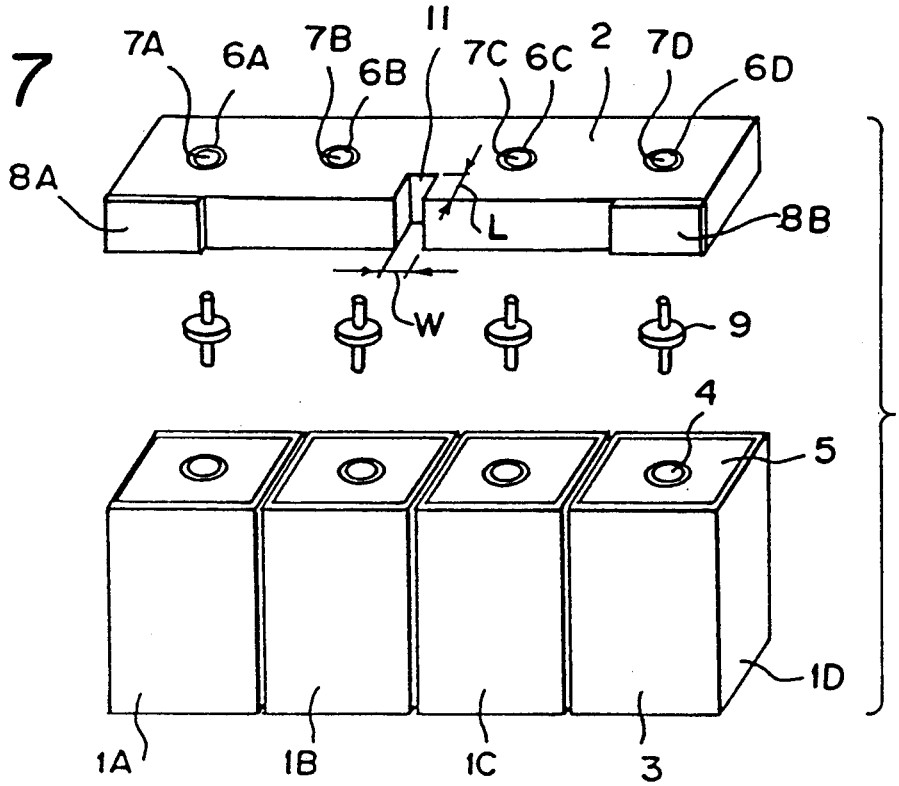
FIG. 7 is a perspective view showing a further embodiment of the present invention.

In the third embodiment illustrated in FIG. 7, four dielectric resonators are combined together, and the coupling capacitance between electrodes 7B and 7C in holes of a coupling dielectric block 2 corresponding to inner conductors 4 of the second and third resonators is adjusted by forming a slit 11 in the dielectric block 2, the slit 11 having a width W and a length L. Other constructional points are the same as in the first embodiment.

Figure 8:
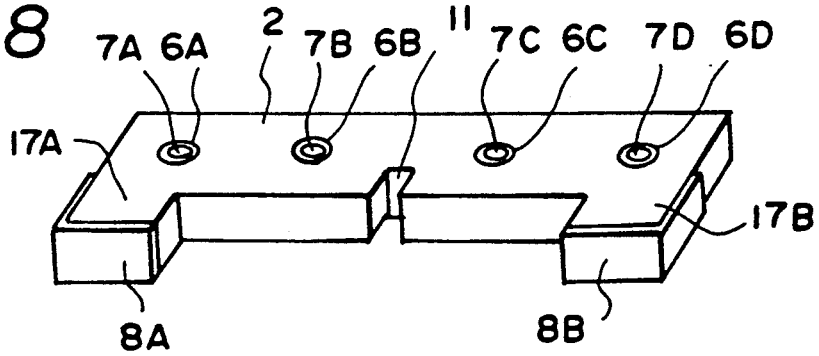
FIG. 8 is a perspective view showing a dielectric block used in the present invention.
Figure 9:
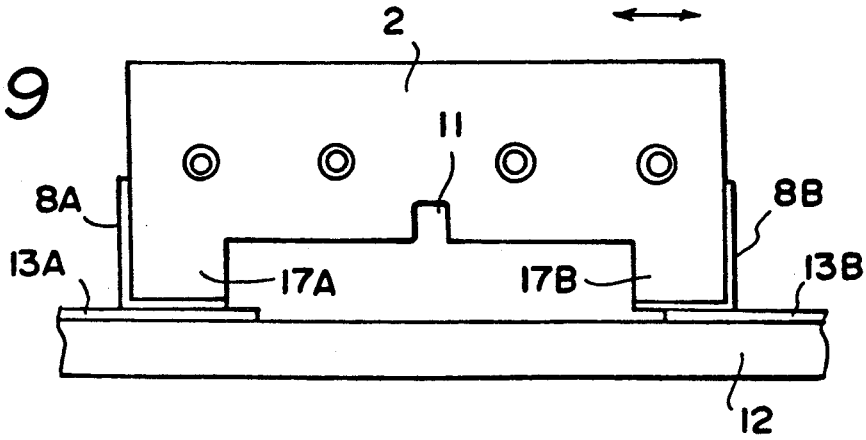
FIG. 9 shows the dielectric block of FIG. 8 mounted on a circuit board.

A modification of the dielectric block used in the third embodiment is shown in FIG. 8. In this modification, the dielectric block 2 has protuberances 17A and 17B laterally projecting at both end portions, side faces (this side in FIG. 8) of which are substantially flush with each other. An input terminal electrode 8A and an output terminal electrode 8B are formed on the side faces. As illustrated in FIG. 8, the input and output terminal electrodes 8A and 8B each extend up to an end face. According to such a construction, a considerable amount of discrepancy in position of the filter with respect to the wiring pattern on the circuit board is allowable. In fact, if the dielectric block 2 is roughly positioned with respect to the input and output lines 13A and 13B on the circuit board 12 to cause a discrepancy of position in the direction of the arrow as illustrated in FIG. 9, the variation of each capacitance is relatively small because a side face of the dielectric block 2 bearing no terminal electrode is separated from the input and output lines 13A and 13B, and therefore the severe positioning is not required.

Figure 10:
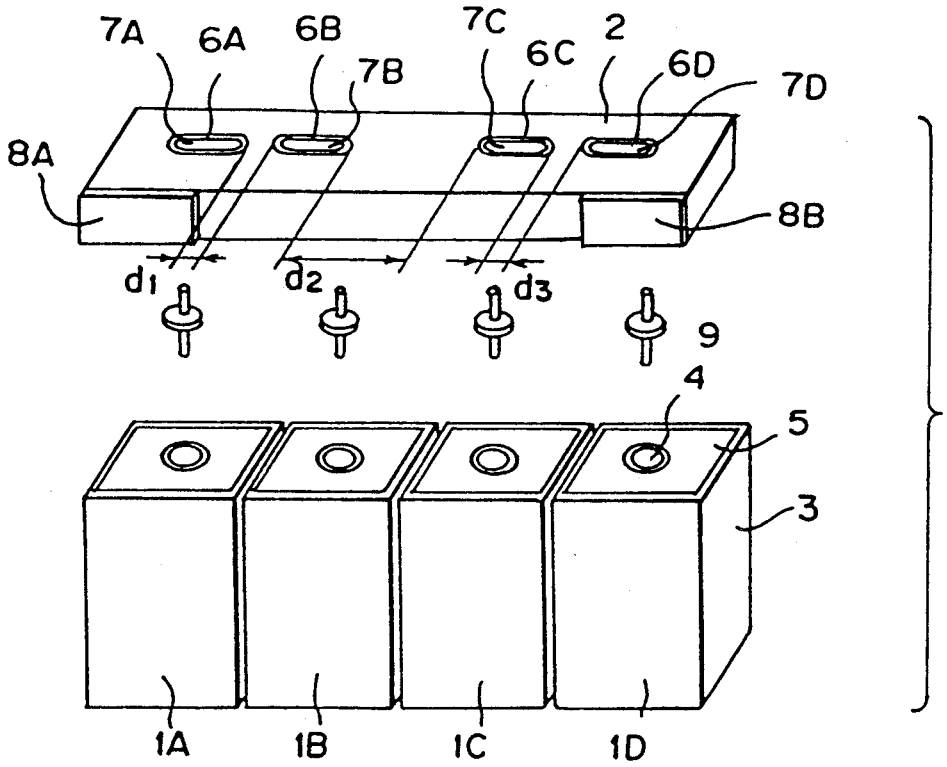
FIG. 10 is a perspective view showing another embodiment of the present invention.
Figure 11:
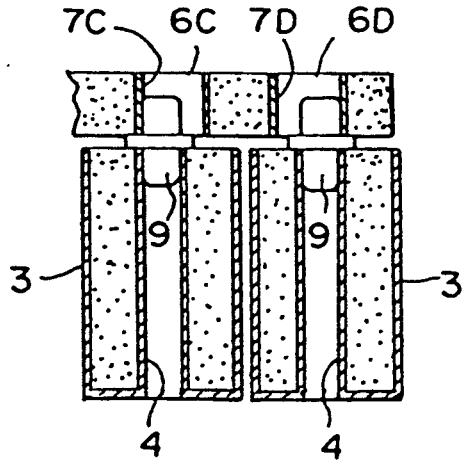
FIG. 11 is a partial, longitudinal sectional view of FIG. 10.

In the fourth embodiment illustrated in FIGS. 10 and 11, holes 6A to 6D are formed in a coupling dielectric block 2, wherein the holes are elongated in the longitudinal direction of the dielectric block (namely in the arranged direction of resonators 1A–1D), and adjacent hole spacings are set at desired values of $d_1$ to $d_3$, whereby it is made possible to determine each coupling capacitance between two adjacent electrodes 7A and 7B, 7B and 7C, 7C and 7D.

Figure 12:
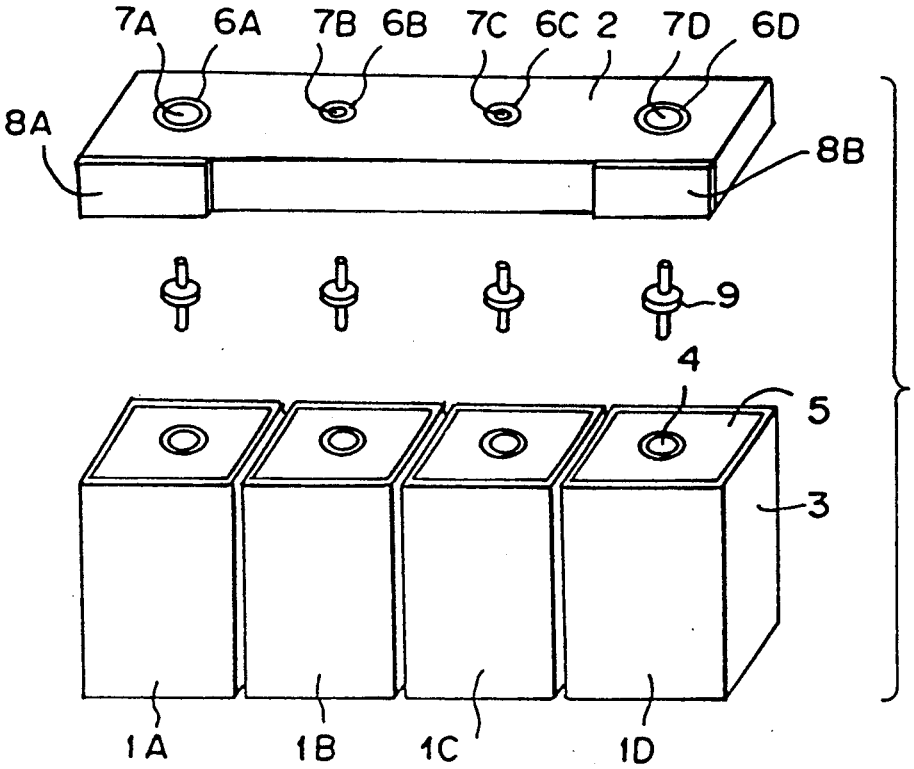
FIG. 12 is a perspective view showing a further embodiment of the present invention.

In the fifth embodiment illustrated in FIG. 12, the diameters of holes 6A to 6D formed in a coupling dielectric block 2 are set at suitable values, to thereby adjust each coupling capacitance between two adjacent electrodes 7A and 7B, 7B and 7C, 7C and 7D.

Figure 13:
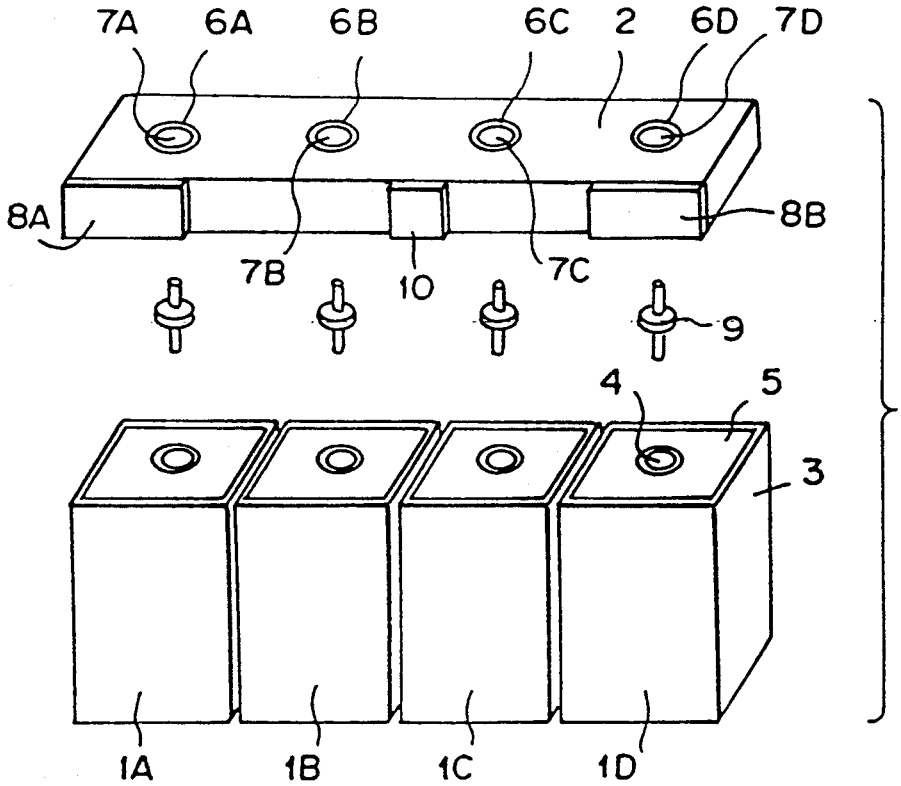
FIG. 13 is a perspective view showing another embodiment of the present invention.

In the sixth embodiment, illustrated in FIG. 13, an earth electrode 10 is formed on a side face of a coupling dielectric block 2 on which both input and output terminal electrodes 8A, 8B are formed. The earth electrode 10 is connected to an earth line of a wiring pattern formed on a circuit board, whereby the coupling capacitance between resonators 1B and 1C is lowered as compared with that between resonators 1A and 1B, 1C and 1D.

Figure 14:
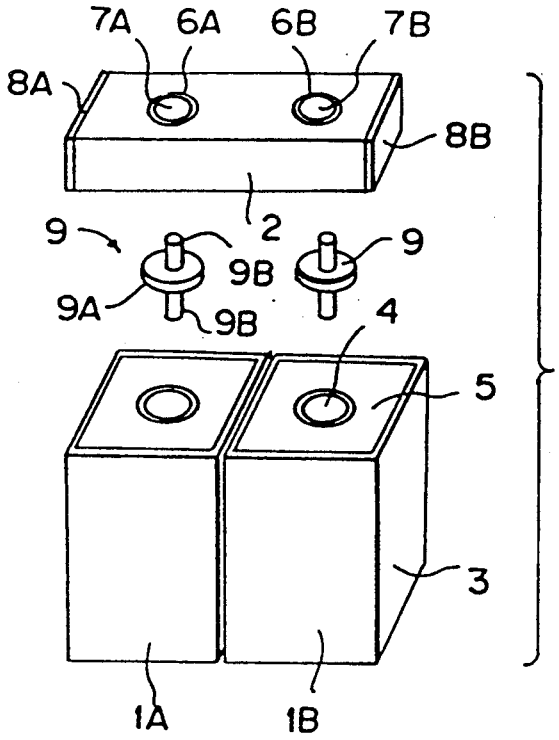
FIG. 14 is a perspective view showing a further embodiment of the present invention.
Figure 15:
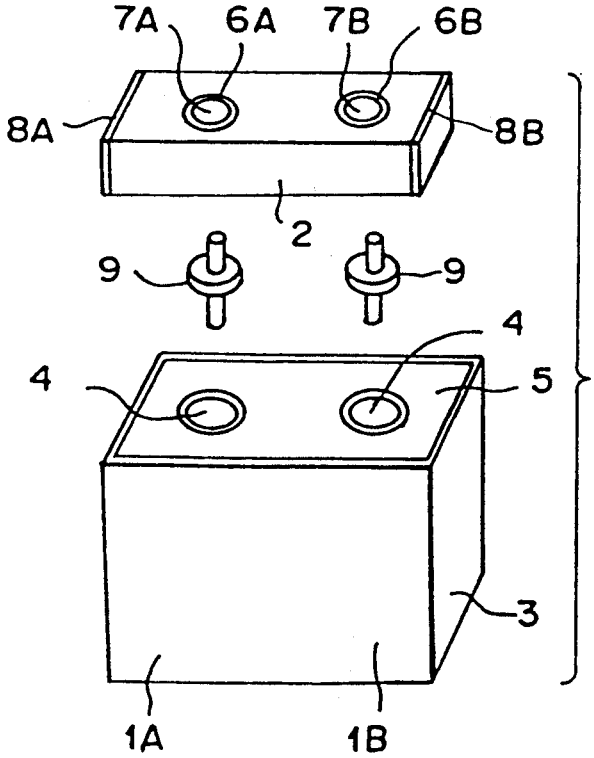
FIG. 15 is a perspective view showing another embodiment of the present invention.
Figure 16:
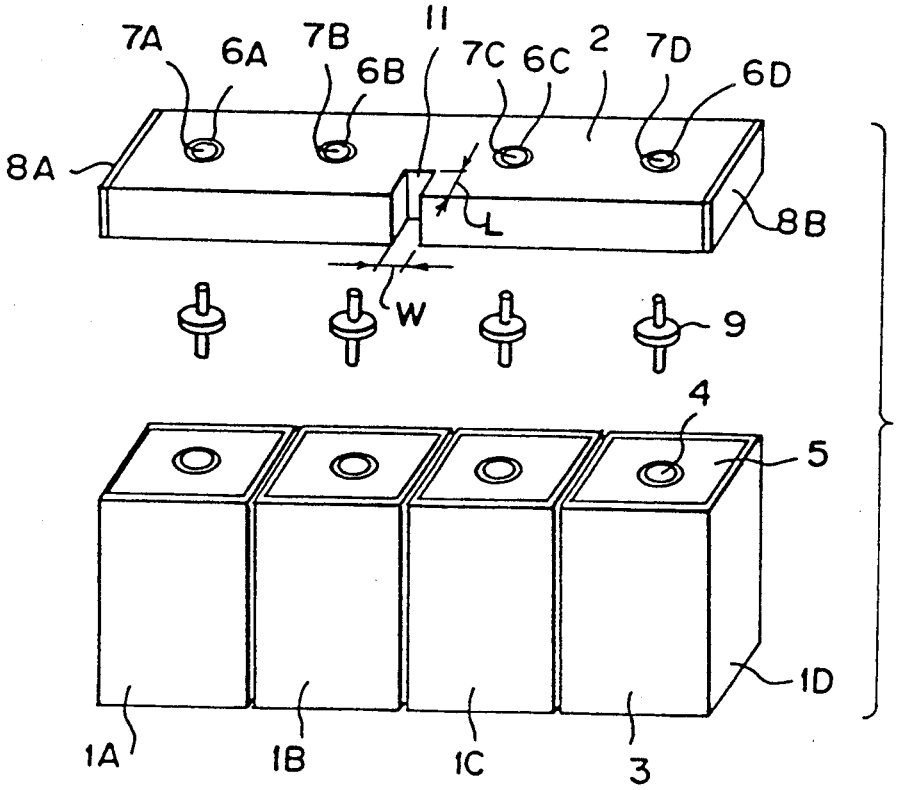
FIG. 16 is a perspective view showing a further embodiment of the present invention.

In the seventh embodiment illustrated in FIG. 14, an input terminal electrode 8A and an output terminal electrode 8B are formed on end, outer peripheral faces of a coupling dielectric block 2. Other constructional points are the same as in the first embodiment.

The eighth, ninth, tenth, eleventh and twelfth embodiments, illustrated in FIGS. 15, 16, 17, 18 and 19, respectively, are the same as the above second, third, fourth, fifth and sixth embodiments, respectively, except that in each of them an input terminal electrode 8A and an output terminal electrode 8B are formed only on end faces of a coupling dielectric block 2.

Figure 17:
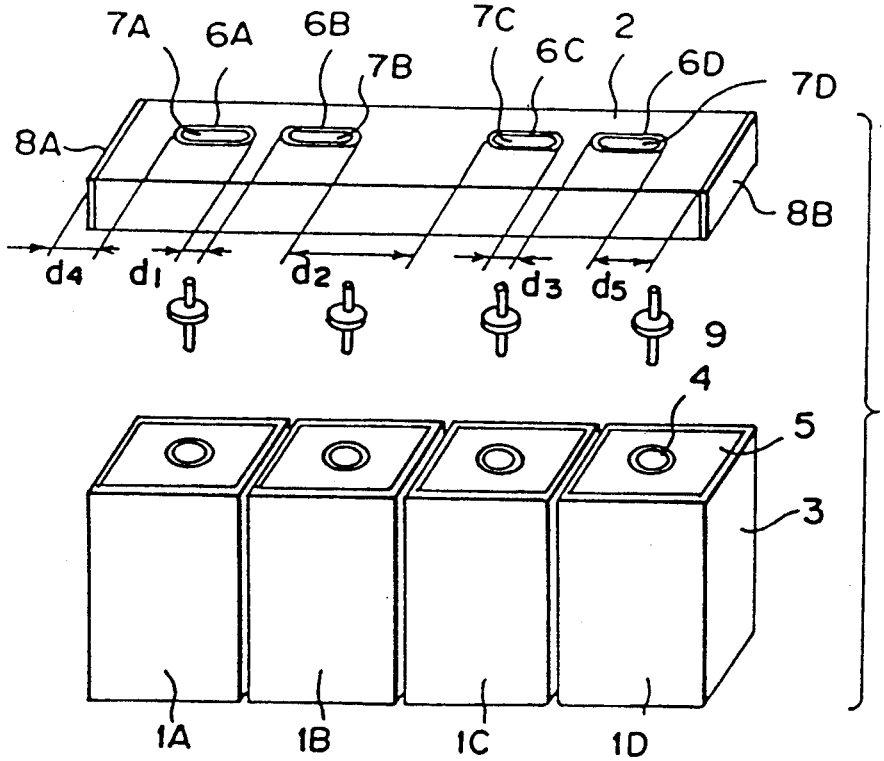
FIG. 17 is a perspective view showing another embodiment of the present invention.
Figure 18:
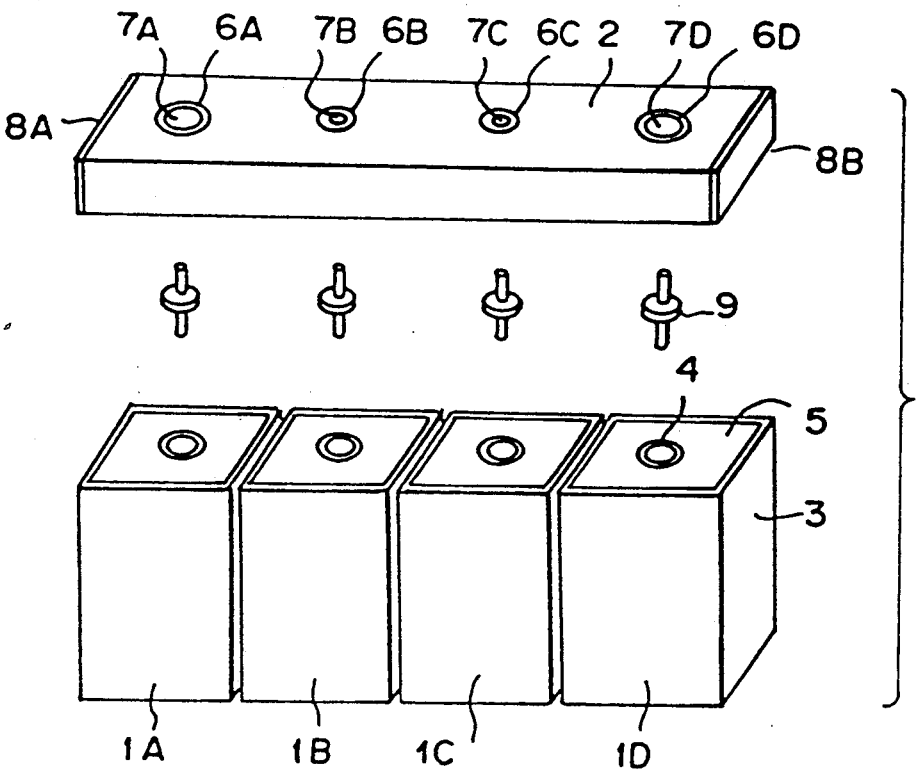
FIG. 18 is a perspective view showing a further embodiment of the present invention.
Figure 19:
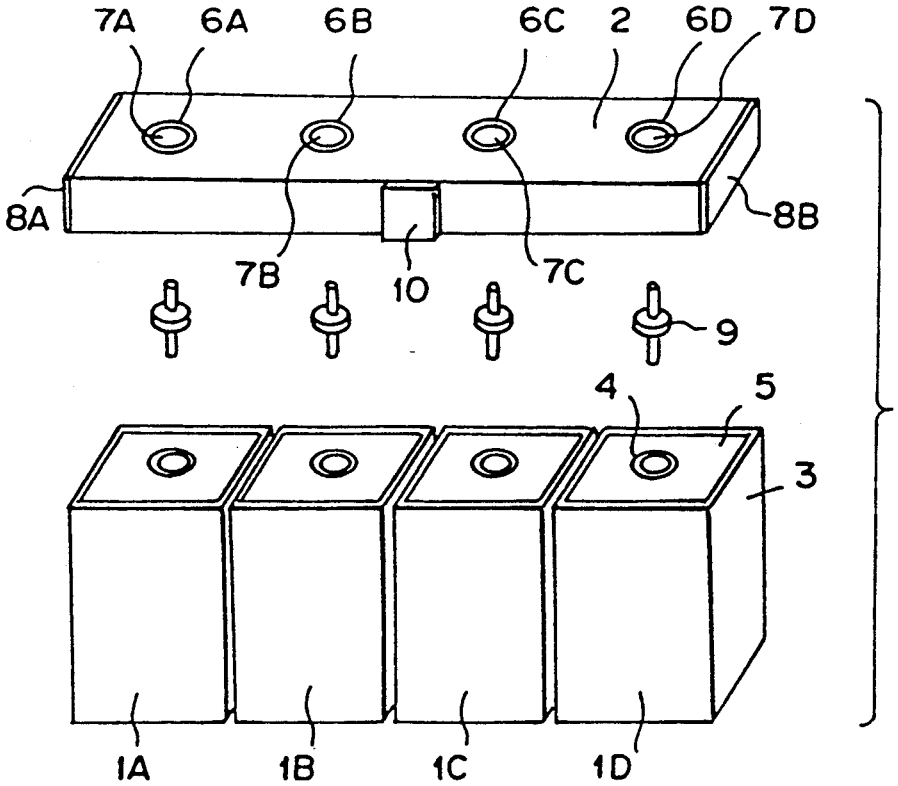
FIG. 19 is a perspective view showing a still further embodiment of the present invention.

In the tenth embodiment illustrated in FIG. 17, the spacing between a hole 6A and one end face of a coupling dielectric block 2 is set at a desired value of $d_4$, and the spacing between a hole 6D and an opposite end face of the dielectric block 2 is set at a desired value of $d_5$, whereby the coupling capacitance between an electrode 7A and an input terminal electrode 8A, as well as the coupling capacitance between an electrode 7D and an output terminal electrode 8D, can be determined.

What is claimed is:

1. A dielectric filter coupler structure, comprising:

a plurality of resonators, each of said resonators having an outer conductor and an inner conductor which is disposed coaxially with said outer conductor with respect to an axis, a dielectric material being disposed between said inner and outer conductors;

a rectangular dielectric block having a connecting surface which extends in a direction essentially perpendicular to said axis, said connecting surface being disposed in parallel opposition to a top surface of said resonators, said dielectric block having holes formed therein, each of said holes extending in direction which is parallel to said axis and being in opposed relation to a corresponding one of said inner conductors, a coupling electrode being formed on an inner surface of each of said holes;

a spacer disposed between each of said coupling electrodes and a corresponding one of said inner conductors;

an input terminal electrode, at least a portion of said input terminal electrode being formed on a first outer peripheral surface portion of said dielectric block, said first outer peripheral surface portion lying in a plane which is parallel to said axis; and an output terminal electrode, at lest a portion of said output terminal electrode being formed on a second outer peripheral surface portion of said dielectric block, said second outer peripheral surface portion lying in a plane which is parallel to said axis.

2. A dielectric filter coupling structure according to claim 1, wherein said first outer peripheral surface portion and said second outer peripheral surface portion are substantially in a first plane.

3. A dielectric filter coupling structure according to claim 2, wherein an earth electrode for determining a coupling capacitance between said resonators is formed on a third outer peripheral surface portion of said dielectric block said earth electrode being substantially in said first plane.

4. A dielectric filter coupling structure according to claim 1, where said first and second outer peripheral surface portions of said dielectric block are respective end positions, of said dielectric block with respect to a direction transverse to said holes.

5. A dielectric filter coupling structure according to claim 1, wherein said coupling electrodes of said dielectric block and respective ones of said inner conductors are each coupled by an electrical connection.

6. A dielectric filter coupling structure according to claim 5, wherein said electrical connections between each of said coupling electrodes and a respective of said inner conductors is performed by said spacer which is made of electroconductive material.

7. A dielectric filter coupling structure according to claim 1, wherein an earth electrode for determining a coupling capacitance between said resonators is formed on an outer peripheral face of said dielectric block.

8. A dielectric filter coupling structure according to claim 1, wherein said holes of said dielectric block are each formed in a predetermined shape, size and relative position so as to yield a predetermined coupling capacitance between each of said coupling electrodes and an adjacent coupling electrode and said input and output terminal electrodes.

9. A dielectric filter coupling structure according to claim 1, wherein a slit for determining a coupling capacitance between said electrodes in said holes is formed in outer peripheral face of said dielectric block.

10. A coupling structure according to claim 1, wherein said outer conductors comprise a single common outer conductor.

11. A coupling structure according to claim 1, wherein said holes are round in cross section.

12. A coupling structure according to claim 1, wherein said holes are oval in cross section.

* * * * *